US007950190B2

(12) United States Patent
Schulze

(10) Patent No.: US 7,950,190 B2
(45) Date of Patent: May 31, 2011

(54) CONCRETE PANEL LIFTING INSERT ASSEMBLY

(76) Inventor: Todd M. Schulze, Mooresville, NC (US)

( * ) Notice: Subject to any disclaimer, the term of this patent is extended or adjusted under 35 U.S.C. 154(b) by 355 days.

(21) Appl. No.: 12/190,136

(22) Filed: Aug. 12, 2008

(65) Prior Publication Data

US 2010/0037536 A1 Feb. 18, 2010

(51) Int. Cl.
*E04B 1/38* (2006.01)

(52) U.S. Cl. ..... 52/125.4; 52/125.2

(58) Field of Classification Search ..... 52/125.4, 52/125.2, 700, 707, 704, 677; 294/89
See application file for complete search history.

(56) References Cited

U.S. PATENT DOCUMENTS

| | | | | | |
|---|---|---|---|---|---|
| 3,195,278 | A * | 7/1965 | Ballou | 52/705 |
| 3,431,012 | A * | 3/1969 | Eriksson et al. | 294/89 |
| 3,705,469 | A * | 12/1972 | Eriksson | 52/125.4 |
| 4,000,591 | A * | 1/1977 | Courtois | 52/689 |
| 4,017,115 | A * | 4/1977 | Holt et al. | 294/89 |
| 4,367,892 | A * | 1/1983 | Holt | 294/89 |
| 4,437,642 | A * | 3/1984 | Holt | 249/175 |
| 4,580,378 | A * | 4/1986 | Kelly et al. | 52/125.5 |
| 4,930,269 | A | 6/1990 | Kelly et al. | |
| 5,014,473 | A | 5/1991 | Kelly et al. | |
| 5,094,047 | A * | 3/1992 | Kelly et al. | 52/125.5 |
| 5,226,265 | A * | 7/1993 | Kelly et al. | 52/125.6 |
| 5,588,263 | A * | 12/1996 | Kelly et al. | 52/125.4 |
| 6,279,274 | B1 * | 8/2001 | Amiet et al. | 52/125.2 |
| 6,341,452 | B1 * | 1/2002 | Bollinghaus | 52/125.5 |
| 6,769,663 | B2 | 8/2004 | Kelly et al. | |
| 6,779,312 | B2 * | 8/2004 | Wright | 52/125.5 |

* cited by examiner

*Primary Examiner* — Brian E Glessner
*Assistant Examiner* — Beth Stephan
(74) *Attorney, Agent, or Firm* — Dennis G. LaPointe

(57) ABSTRACT

A concrete panel lifting insert assembly that includes an X-shaped foot and an insert, which is generally pear-shaped or triangular-shaped, having a bottom side which is elongated. The insert's bottom side is secured to a cross-member of the X-shaped foot such that the insert stands in a vertical orientation. The other cross-member of the X-shaped foot is in a transverse tangential orientation to that of an opening formed by the pear-shaped or triangular-shaped insert. This other cross-member optionally includes elevated C-shaped clips for engaging rebar material to provide additional strength.

4 Claims, 5 Drawing Sheets

CONCRETE PANEL LIFTING INSERT ASSEMBLY

FIELD OF THE INVENTION

The invention relates to lifting inserts for concrete panels.

BACKGROUND OF THE INVENTION

During construction of pre-cast concrete panels and on-site field pouring of concrete panels, lifting inserts have to be strategically placed prior to pouring the concrete so that after the concrete is cured, means are provided to mechanically connect the hooks and hoisting cables to the panel enabling the crane to lift the panel in place. The present invention is an improved insert assembly that provides added safety to the workers handling the lifting of the panels.

SUMMARY OF THE INVENTION

The insert of the present invention is a pear-shaped or generally triangular-shaped metal insert. It can be round in cross-section or square shaped in cross-section. It can also be uniformly cast as a one piece insert or formed such that its bottom leg is spot welded near the center of the bottom leg. The metal material is steel material.

The bottom leg of the insert is placed in an overlying relationship to an X-shaped base or foot where the insert's bottom leg is secured to one of the cross-members or two co-linear legs of the foot. There are several ways know in the art to secure the insert to the foot such as using straps or fasteners but the preferred method is to have means for the insert bottom legs to snap into ridges or clips provided on the foot. The intent is to hold the insert perpendically in place while the concrete is being poured. This preferred snap into place engagement is less labor intensive. The foot or base is preferably made from a molded plastic material or other polymeric composition.

Once each location is identified for a lifting insert to be provided, the foot and its engaged insert is placed on the floor within the form of the panel to be poured at each of such locations. Typical panel heights can vary from 5 inches to 12 inches so the insert height will vary accordingly. Because the concrete is poured close to the top of the insert height, a void needs to be created in the concrete that exposes the curved or rounded apex of the insert. This is done with the addition of a removable cap at the inserts apex prior to pouring the concrete. The cap can thereafter be removed to expose the apex to connect the hoisting cable assembly to each lifting insert embedded in the poured concrete panel. The cap is typically made from a plastic material is generally commercially available from companies such as Meadow Burke Products of Sacramento, Calif. (see U.S. Pat. No. 6,769,663 issued Aug. 3, 2004 to Kelly et al.; U.S. Pat. No. 5,014,473 issued May 14, 1991 to Kelly et al.; and U.S. Pat. No. 4,930,269 issued Jun. 5, 1990 to Kelly et al.).

In an additional embodiment, the X-shaped foot or base may include on the legs that transverse the insert opening one or more vertical legs with C-shaped clips at the end of the vertical legs that are sized to receive and engage rebar material that can pass through the formed opening of the insert at an intermediate position between the removable cap and the bottom leg or side of the insert.

DETAILED DESCRIPTION OF THE INVENTION

Figure 1:
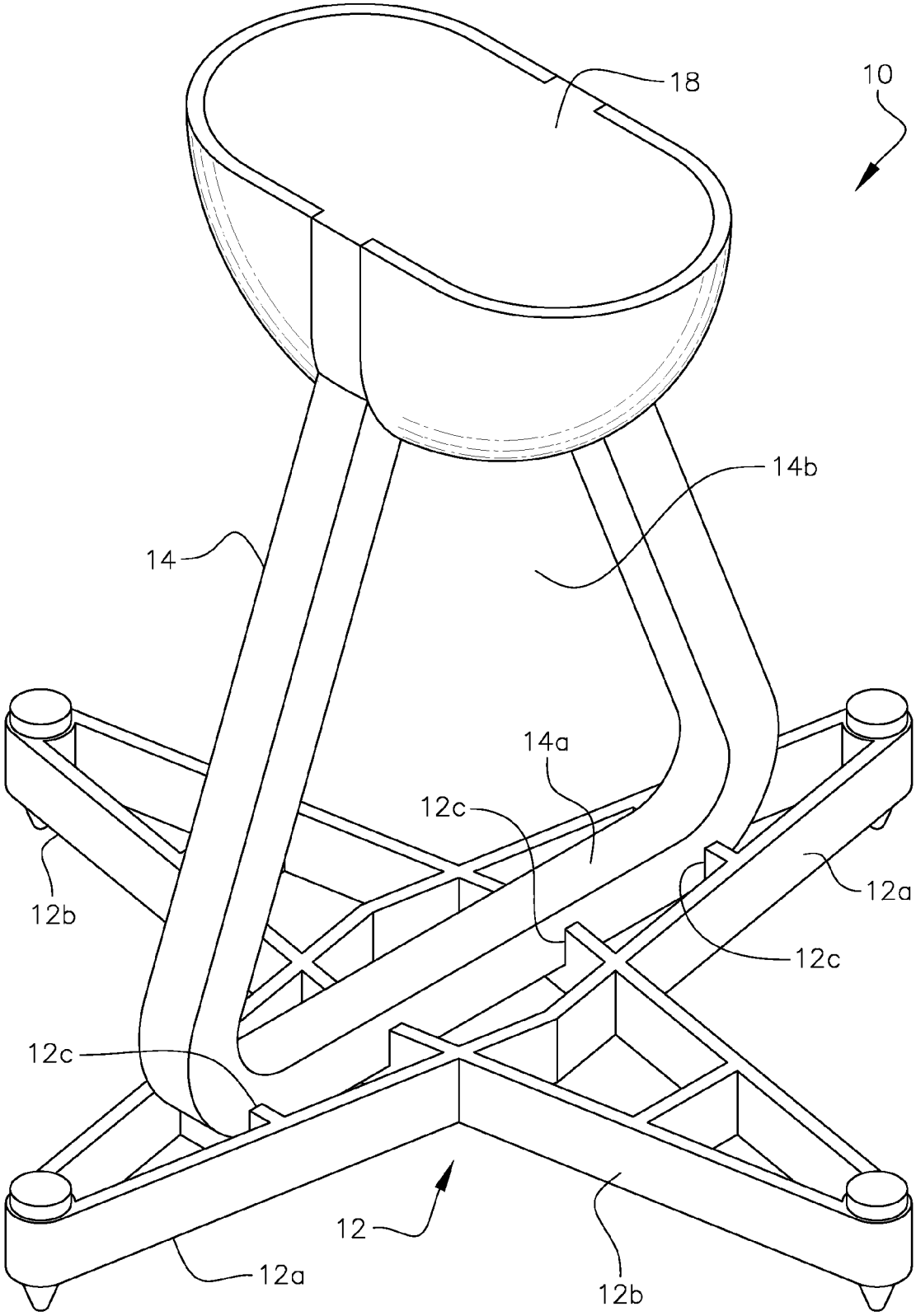
FIG. 1 is a perspective conceptual view of one example of the present invention lifting insert assembly with the removable plastic cap covering the apex of the insert.
Figure 2:
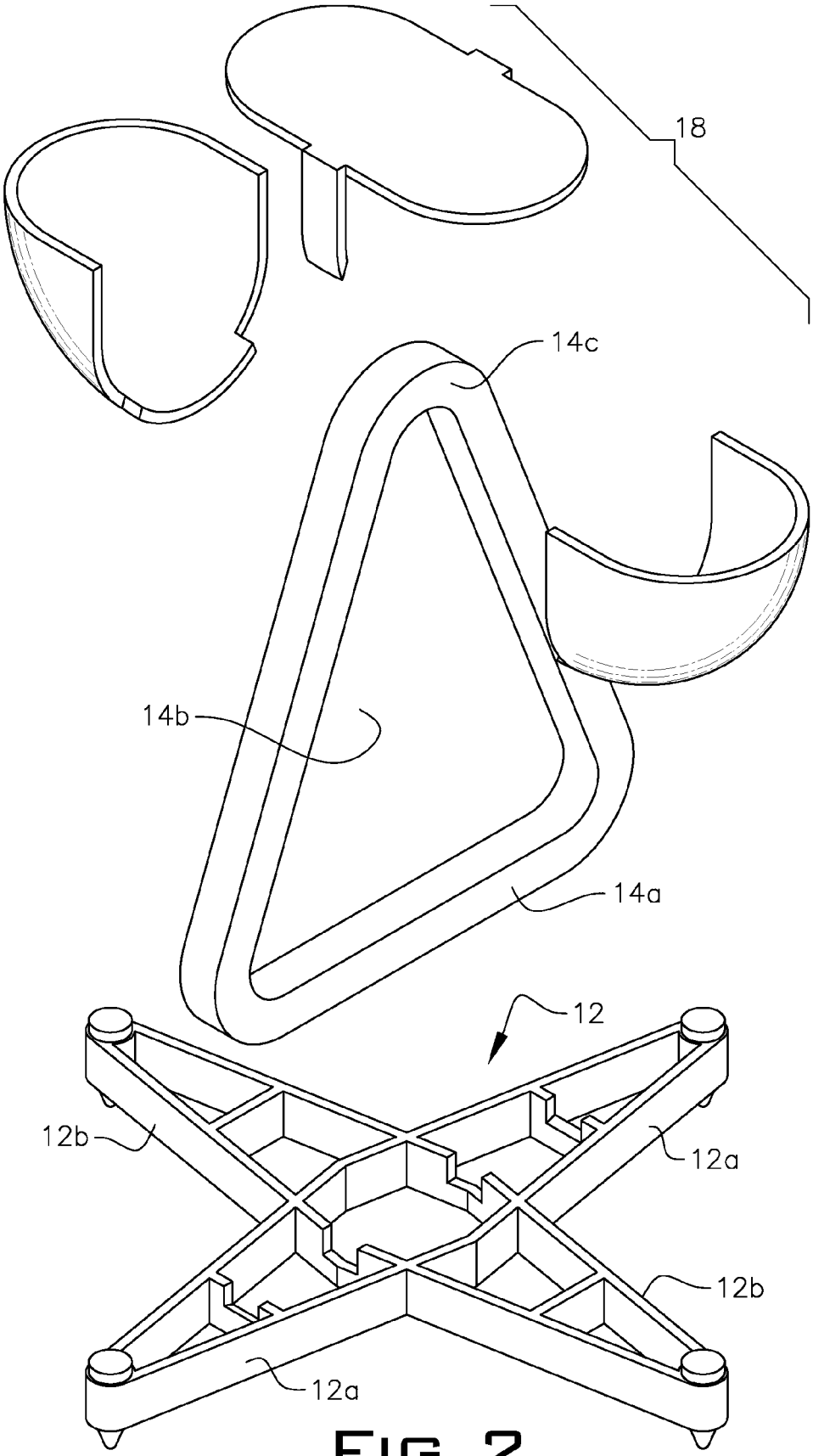
FIG. 2 is an exploded view of the components depicted in FIG. 1.
Figure 3:
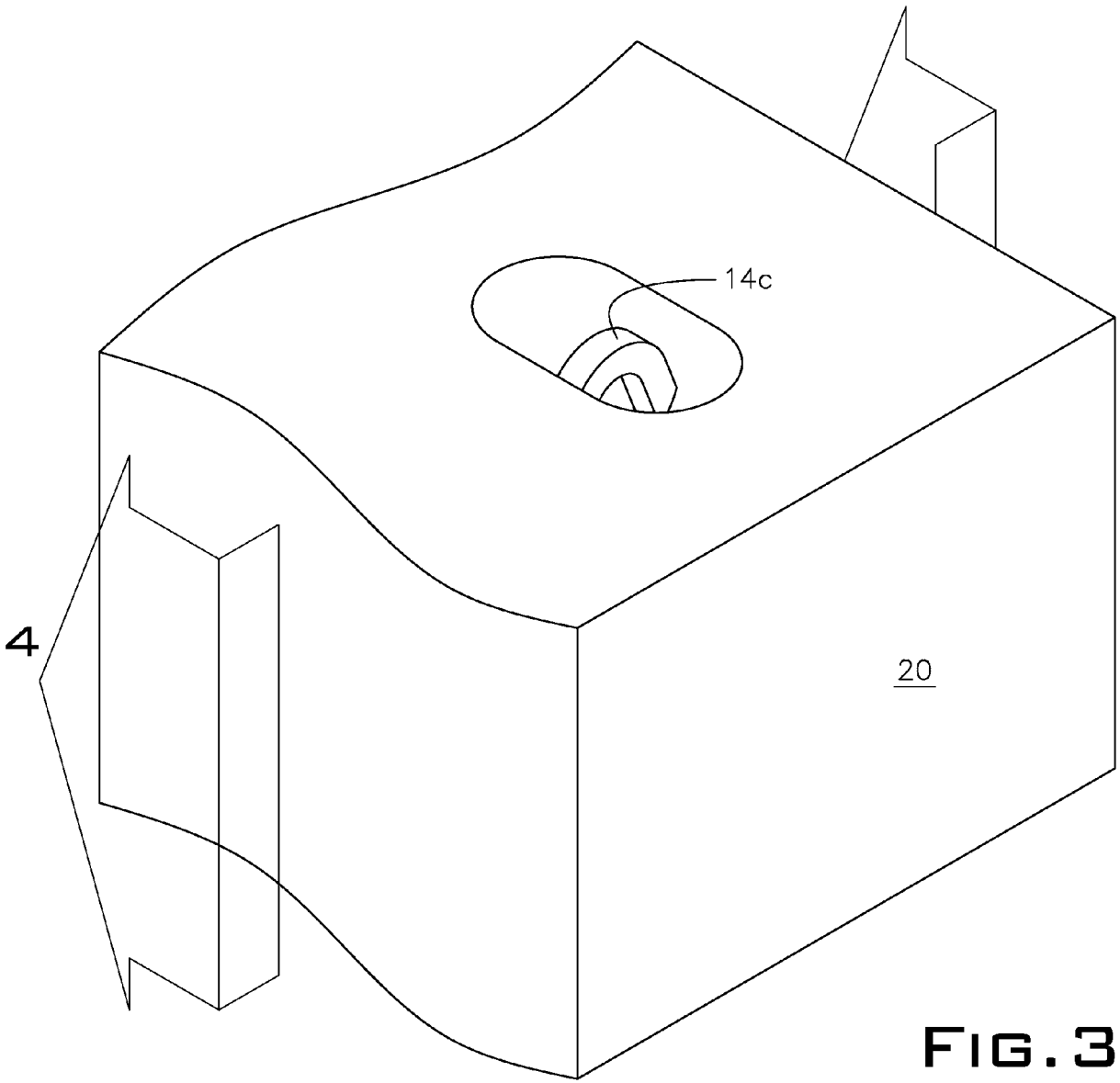
FIG. 3 is a representative depiction of one insert assembly in a portion of a poured concrete panel with the removable cap removed and the apex alone exposed to install one of the lifting legs used by a crane to lift the panel in place.
Figure 4:
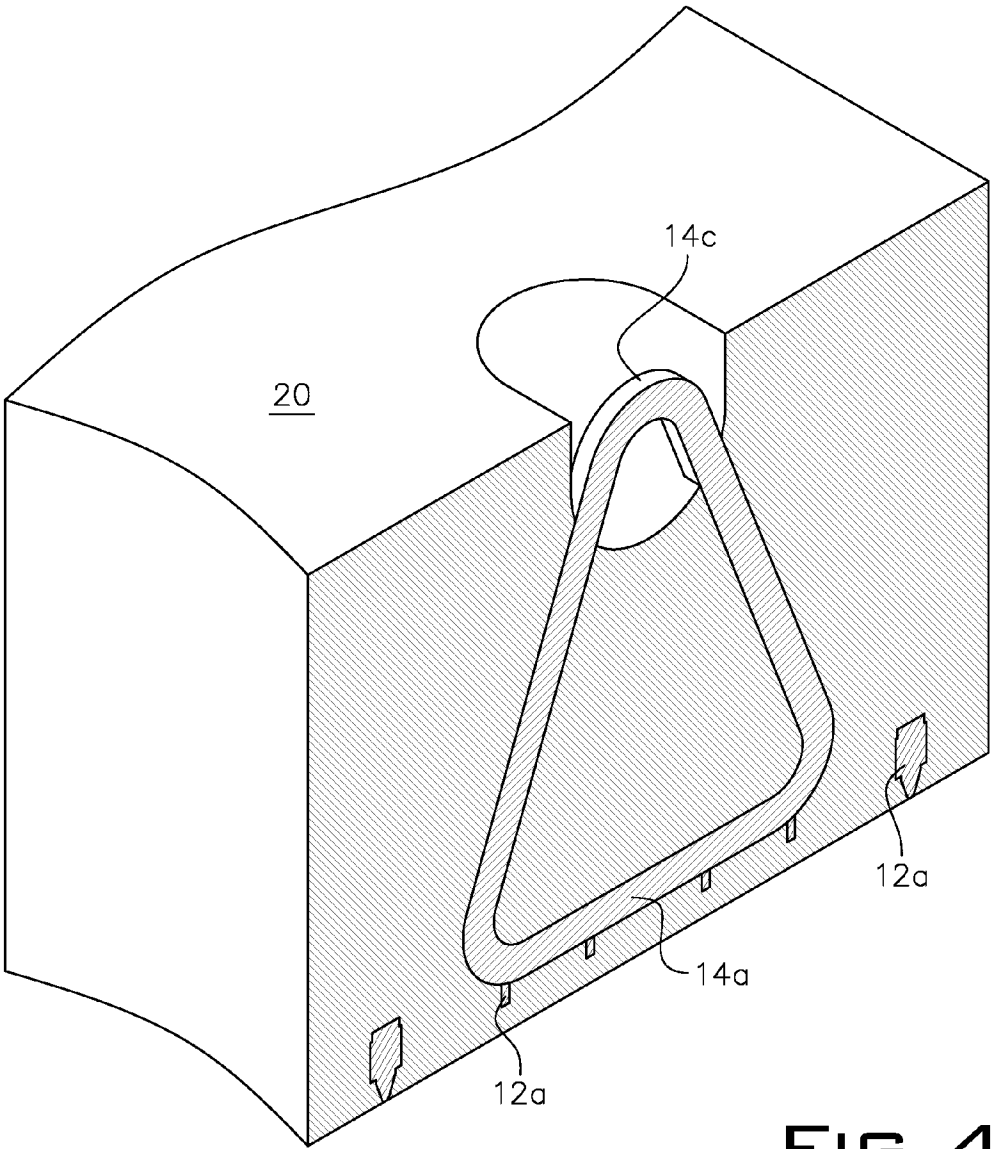
FIG. 4 is a cross-section depiction of the insert assembly of FIG. 3.

Referring now to the drawings, FIGS. 1-5 disclose representative examples of the present invention, which is a concrete panel lifting insert assembly, depicted generally as 10.

The inventive concrete panel 20 lifting insert assembly 10 includes an X-shaped foot 12 and an insert 14, which is generally pear-shaped or triangular-shaped, having a bottom side 14*a*, which is elongated and is rigidly made in a continuous length by splicing, lapping or welding. A cross-member 12*a* of the X-shaped foot 12 has means for securing and engaging the elongated bottom side 14*a* of the insert 14 such that the insert 14 stands in a vertical orientation. The X-shaped foot 14 is formed so that its other cross-member 12*b* is generally perpendicular to cross-member 12*a* and is in a transverse generally tangential orientation to that of an opening 14*b* formed by the pear-shaped or triangular-shaped insert 14.

A preferred method of providing means for securing and engaging the elongated bottom side 14*a* of the insert 14 to the cross-member 12*a* of the foot 12 is one or more pairs of opposing spaced-apart clips or insets 12*c* formed to frictionally engage the bottom side 14*a* of the insert 14 into a secure engagement with the cross-member 12*a*. These clips or insets 12*c* can be located where desired along member 12*a* up to and including at the opposite corners of member 12*a*.

Figure 5:
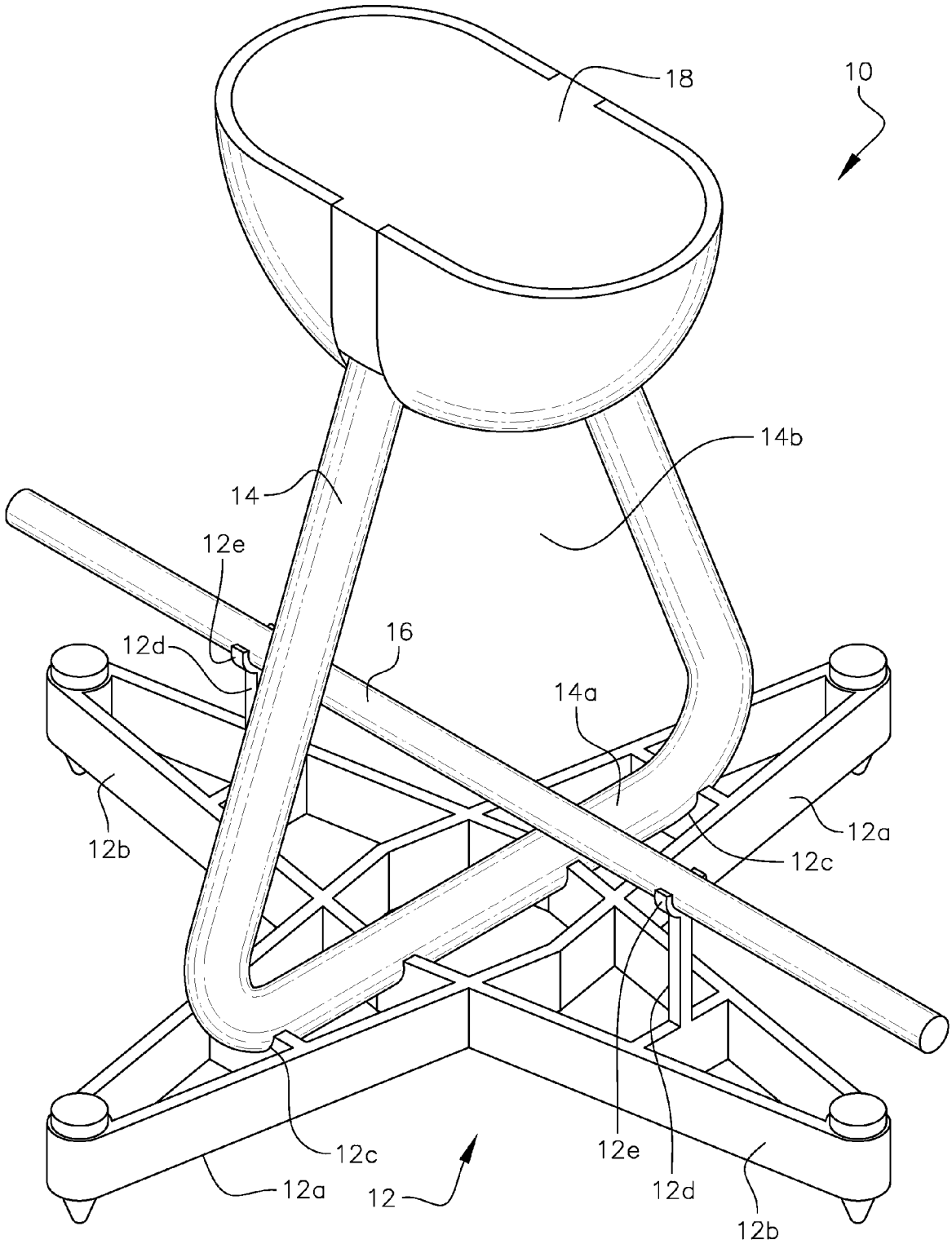
FIG. 5 is a perspective view of another example of the invention depicting a circular cross-section of the steel insert portion as well as clips for installing rebar through the opening of the steel insert.

As shown in FIGS. 1 and 5, the insert 14 can have a square or rectangular cross-section shape or a generally circular cross-section shape. A generally oval shape is considered generally circular for purposes of intended shapes for the insert 14.

As mentioned above, the other cross-member 12*b* of said foot 12 that is in a transverse tangential orientation to that of the opening 14*b* formed by the pear-shaped or triangular-shaped insert 14, further comprises at least one elongate member 12*d* extending vertically from the other cross-member 12*b* with a C-shaped clip 12*e* at an end of the vertical elongate member 12*d* that is sized to receive and engage a rebar material 16. The C-shaped clip 12*e* serving as means for holding additional piece of reinforcing rebar material 16 giving the formed opening 14*b* of the insert 14 additional reinforcement making this pear-shaped insert have more pull strength. The rebar material 16 is located at an intermediate position between an apex 14*c* of the insert 14 and the bottom side 14*a* of the insert 14. A removable cap 18 is placed at the apex 14*c* of the insert 14 to create a void after pouring the concrete panel 20 (portion surrounding one lifting insert assembly shown only in FIGS. 3 and 4). After the panel 20 is poured, the cap 18 is removed and the apex portion 14*c* of the insert 14 is exposed for connecting the lifting and handling cables for lifting the panels by a crane. Cap 18 is typically a plastic cap such as that described in the above mentions issued patents to Kelly et al., all now owned by Meadow Burke Products of Sacramento, Calif. Effectively, the elevation of the vertical leg 12*d* and the C-shaped clip 12*e* is such that the rebar 16 will pass through the opening 14*b* of the insert 14 at an intermediate position between the removable cap 18 and the bottom leg or side 14*a* of the insert 14 creating additional strength to member 14*b*.

The foot 12 can be made from a variety of materials but preferably is molded from a plastic or polymeric composite material. The insert 14 is typically made from a steel material.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A concrete panel lifting insert assembly comprising:

an X-shaped foot;

an insert, which is generally pear-shaped or triangular-shaped, having a bottom side which is elongated; and a cross-member of said X-shaped foot having means for securing and engaging said elongated bottom side of said insert such that said insert stands in a vertical orientation, the X-shaped foot being formed so that its other cross-member is in a transverse tangential orientation to that of an opening formed by said pear-shaped or triangular-shaped insert, wherein said other cross-member of said foot that is in said transverse tangential orientation to that of said opening formed by said pear-shaped or triangular-shaped insert, further comprises at least one elongate member extending vertically from said other cross-member with a C-shaped clip at an end of the at least one elongate member that is sized to receive and engage a rebar material, said C-shaped clip serving as means for holding said rebar material through said formed opening of said insert at an intermediate position between an apex of said insert and said bottom side of said insert.

2. The assembly according to claim 1, wherein said means for securing and engaging said elongated bottom side of said insert to said cross-member of said foot is one or more pairs of opposing spaced-apart clips or insets formed to frictionally engage said bottom side of said insert into a secure engagement with said cross-member.

3. The assembly according to claim 1, wherein said foot is made from a plastic or polymeric composite material.

4. The assembly according to claim 1, wherein said insert is made from a steel material.

* * * * *